US010835012B2

(12) United States Patent
Schlatter et al.

(10) Patent No.: US 10,835,012 B2
(45) Date of Patent: Nov. 17, 2020

(54) COSMETIC PRODUCT CONTAINER

(71) Applicant: ORALABS, INC., Parker, CO (US)

(72) Inventors: Gary Schlatter, Parker, CO (US); Chris P. Turner, Parker, CO (US)

(73) Assignee: Oralabs, Inc., Parker, CO (US)

( * ) Notice: Subject to any disclaimer, the term of this patent is extended or adjusted under 35 U.S.C. 154(b) by 0 days.

(21) Appl. No.: 16/131,992

(22) Filed: Sep. 14, 2018

(65) Prior Publication Data

US 2019/0075908 A1 Mar. 14, 2019

Related U.S. Application Data

(60) Provisional application No. 62/558,446, filed on Sep. 14, 2017.

(51) Int. Cl.

| | |
|---|---|
| ***A45D 34/04*** | (2006.01) |
| ***A45D 40/06*** | (2006.01) |
| ***A45D 40/00*** | (2006.01) |
| ***B65D 51/18*** | (2006.01) |

(52) U.S. Cl.

CPC ..... *A45D 34/04* (2013.01); *A45D 40/0068* (2013.01); *A45D 40/06* (2013.01); *B65D 51/18* (2013.01); *A45D 2040/0006* (2013.01); *A45D 2200/05* (2013.01); *A45D 2200/054* (2013.01)

(58) Field of Classification Search

CPC ..... A45D 40/02; A45D 40/06; B65D 41/04; B65D 41/0435; B65D 41/0442; B65D 41/0457; B65D 41/0492

See application file for complete search history.

(56) References Cited

U.S. PATENT DOCUMENTS

| | | | | |
|---|---|---|---|---|
| 4,597,501 A * | 7/1986 | Gueret | B65D 41/0435 | 215/330 |
| 5,863,145 A * | 1/1999 | Dumler | A45D 34/045 | 215/331 |
| 6,036,387 A * | 3/2000 | Gueret | A45D 40/06 | 401/78 |
| 6,609,287 B2 * | 8/2003 | Evans | B65D 41/0492 | 215/303 |
| 6,682,243 B2 * | 1/2004 | Iwamoto | A45D 40/06 | 401/75 |
| 7,553,101 B2 * | 6/2009 | Harano | A45D 40/06 | 401/75 |
| 8,651,308 B1 * | 2/2014 | Sung | A45D 40/00 | 220/4.25 |

(Continued)

*Primary Examiner* — David P Angwin
*Assistant Examiner* — Bradley S Oliver
(74) *Attorney, Agent, or Firm* — Welsh Flaxman & Gitler LLC

(57) ABSTRACT

A cosmetic container includes a base member having a base member housing with an exterior surface and an interior surface defining a cavity. The cosmetic container also includes a cap member shaped and dimensioned for selectively coupling to the base member; and a threaded cap engagement member shaped and dimensioned for securing to an interior surface of the cap member. The threaded cap engagement member is substantially annular in shape and includes an exterior surface formed with a series of grooves and an interior surface formed with internal projections defining internal threading of the cap member when the threaded cap engagement member is secured to the interior surface of the cap member.

12 Claims, 5 Drawing Sheets

(56) References Cited

U.S. PATENT DOCUMENTS

| | | | | |
|---|---|---|---|---|
| 9,974,377 | B2 * | 5/2018 | Keller | A45D 40/0068 |
| 10,485,324 | B2 * | 11/2019 | Kim | B65D 83/0011 |
| 2017/0013935 | A1 * | 1/2017 | Schlatter | A45D 33/02 |
| 2017/0013936 | A1 * | 1/2017 | Schlatter | A45D 33/02 |
| 2018/0327147 | A1 * | 11/2018 | Santini | B65D 41/0492 |

* cited by examiner

COSMETIC PRODUCT CONTAINER

CROSS REFERENCE TO RELATED APPLICATION

This application claims the benefit of U.S. Provisional Patent Application Ser. No. 62/558,446, entitled "COSMETIC PRODUCT CONTAINER," filed Sep. 14, 2017.

BACKGROUND OF THE INVENTION

1. Field of the Invention

The present invention generally relates to a container for cosmetic product and method of assembling the container.

2. Description of the Related Art

Push-up dispensers are well known in the cosmetic industry. Some rely upon a simple mechanism by which the product platform is simply pushed from below to dispense the product sitting upon the platform. Other dispensers rely upon a screw mechanism for controlled movement of the platform.

Regardless of which mechanism is employed, the assembly process can be cumbersome and expensive. As such, a need exists for a manufacturing process and associated dispenser construction that obviates existing problems and minimizes the time and expense associated with current manufacturing processes.

SUMMARY OF THE INVENTION

It is, therefore, an object of the present invention to provide a cosmetic container including a base member having a base member housing with an exterior surface and an interior surface defining a cavity. The cosmetic container also includes a cap member shaped and dimensioned for selectively coupling to the base member and a threaded cap engagement member shaped and dimensioned for securing to an interior surface of the cap member. The threaded cap engagement member is substantially annular in shape and includes an exterior surface formed with a series of grooves and an interior surface formed with internal projections defining internal threading of the cap member when the threaded cap engagement member is secured to the interior surface of the cap member.

It is also an object of the present invention to provide a cosmetic container wherein the interior surface of the cap member includes a series of projecting ribs shaped and dimensioned for interdigitating with the grooves formed along the exterior surface of the threaded cap engagement member to couple the threaded cap engagement member along the interior surface of the cap member in a manner preventing relative rotation between the threaded cap engagement member and the cap member.

It is another object of the present invention to provide a cosmetic container wherein the cap member includes a circumferential recess formed along the interior surface thereof and the threaded cap engagement member includes a circumferential projection shaped and dimensioned for positioning within the circumferential recess.

It is a further object of the present invention to provide a cosmetic container wherein the base member is cylindrical shaped and includes an open upper first end and a closed lower second end.

It is also an object of the present invention to provide a cosmetic container wherein the base member housing is of a two-piece construction and includes a cover in the shape of a cup and a cylindrical threaded member shaped and dimensioned to fit within the cover.

It is another object of the present invention to provide a cosmetic container wherein the threaded member is positioned and secured within the cover via a frictional fit.

It is a further object of the present invention to provide a cosmetic container wherein the base member housing includes a circumferential ledge and an upwardly extending ridge having external threading formed thereupon. The upwardly extending ridge extends upwardly from the circumferential ledge to an open upper first end of the base member.

It is also an object of the present invention to provide a cosmetic container wherein the external threading is shaped and dimensioned for engagement with internal threading of the threaded cap engagement member.

It is another object of the present invention to provide a cosmetic container including a rotary dispensing assembly positioned within the cavity of the base member.

It is a further object of the present invention to provide a cosmetic container wherein the rotary dispensing assembly includes a cylindrical elevator support structure mounted for movement within a cylindrical inner sleeve.

It is also an object of the present invention to provide a cosmetic container wherein the rotary dispensing assembly further includes a cylindrical outer sleeve surrounding the cylindrical inner sleeve, the cylindrical outer sleeve being fixedly secured to the base member housing. The cylindrical outer sleeve is secured to the cylindrical elevator support structure such that the cylindrical elevator support structure rotates with the cylindrical outer sleeve as the cylindrical outer sleeve is rotated relative to the cylindrical inner sleeve.

It is another object of the present invention to provide a method for manufacturing a cosmetic container comprising assembling a base member and securing a threaded cap engagement member along the upper end of the base member. The threaded cap engagement member includes internal threading that is engaged with external threading formed along the upper end of the base member. The method also includes pouring cosmetic product within the base member and pressing a cap member downwardly over the base member until the threaded cap engagement member engages with the cap member.

It is a further object of the present invention to provide a method for manufacturing a cosmetic container wherein the step of pressing includes forcing engagement of projecting ribs of the cap member with grooves of the threaded cap engagement member.

It is also an object of the present invention to provide a method for manufacturing a cosmetic container wherein the step of pressing includes pushing the cap member over the threaded cap engagement member until a circumferential projection along the threaded cap engagement member seats within a circumferential recess formed along an interior surface of the cap member.

It is another object of the present invention to provide a method for manufacturing a cosmetic container wherein limiting projections along the interior surface of the cap member limit movement of the threaded cap engagement member into the cap member.

It is a further object of the present invention to provide a method for manufacturing a cosmetic container wherein the base member is cylindrical shaped and includes an open upper first end and a closed lower second end.

It is also an object of the present invention to provide a method for manufacturing a cosmetic container wherein the base member housing is of a two-piece construction and includes a cover in the shape of a cup and a cylindrical threaded member shaped and dimensioned to fit within the cover.

It is another object of the present invention to provide a method for manufacturing a cosmetic container wherein the cylindrical threaded member is positioned and secured via a frictional fit within the cover.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
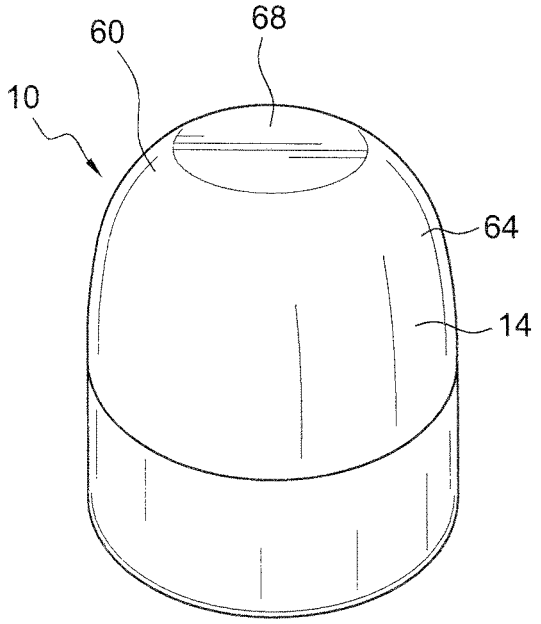
FIG. 1 is a perspective view of the cosmetic product container.
Figure 1:
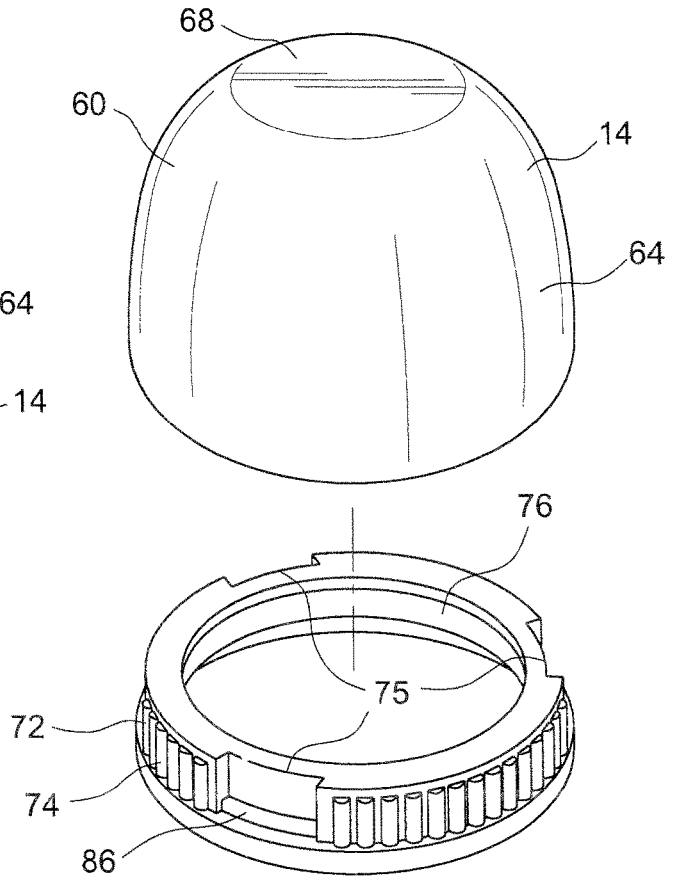

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Referring to FIGS. 1 to 7, the container 10 includes a base member 12 and a cap member 14 shaped and dimensioned for selectively coupling together so as to define a cavity 16 therebetween. Cosmetic product 18 is stored within the base member 12 for ready access by a user when the cap member 14 is removed from the base member 12. It is appreciated the container 10 of the present invention may be used with a variety of cosmetic products including, but not limited to, personal care or medicated products intended for application to the lips or body of an individual (for example, sunscreens, lip colors, moisturizers, etc.), and may take the form of balms, salves, creams, butters, gel products as well as other similar compositions.

The base member 12 as shown is of a "substantially" cylindrical configuration, but could be formed in a variety of shapes. The parts of the base member 12 are preferably formed by plastic injection molding, although it is appreciated other manufacturing techniques may be employed in the manufacture of the base member 12. With such a structure in mind, the base member 12 is cylindrical shaped and has an open upper first end 28. The base member 12 also includes a closed lower second end 30 that is substantially flat to allow it to be supported upon a table, counter, or other flat support surface.

The base member 12 includes a base member housing 13 with an exterior surface 20 and an interior surface 21 forming a cavity 22 in which a dispensing assembly 24 as described below may be mounted. The base member housing 13 is of a two-piece construction and includes a cover 13*a* in the shape of a cup and a cylindrical threaded member 13*b* shaped and dimensioned to fit within the cover 13*a*. In practice, the cover 13*a* and the threaded member 13*b* are separately molded. Once the cover 13*a* and the threaded member 13*b* are molded, the threaded member 13*b* is positioned and secured via a frictional fit within the cover 13*a* to define the assembled base member 12. The interior surface of the cover 13*a* includes spaced ribs (not shown) which interdigitate with a series of grooves (not shown) extending around the circumference of the exterior surface of the threaded member 13*b* to frictionally hold the threaded member 13*b* within the cover 13*a* and also prevent the threaded member 13*b* from rotating within the cover member 13*a*.

As briefly mentioned above, the interior cavity 22 of the base member 12 may house a dispensing assembly 24. It is, however, also contemplated, the base member 12 may be constructed without a dispensing assembly and the cosmetic product would be directly placed within the cavity 22 defined by the base member housing 13.

In accordance with an embodiment as shown with reference to FIGS. 2, 5, 6, and 7A-7D, the dispensing assembly 24 is a rotary dispensing assembly 24*r* preferably similar to the rotary dispensing assemblies disclosed in U.S. Pat. No. 2,345,315, entitled "Cosmetic Stick Expellant Holder" or U.S. Pat. No. 4,108,558, entitled "Lipstick Dispenser", both of which are incorporated herein by reference. However, it is appreciated various dispensing assemblies are known in the art and may be used in accordance with the present invention. In accordance with another embodiment as disclosed with reference to FIG. 2A, the dispensing assembly 24 may be as simple as a cup 24*c* for holding the cosmetic product 18.

Figure 2:
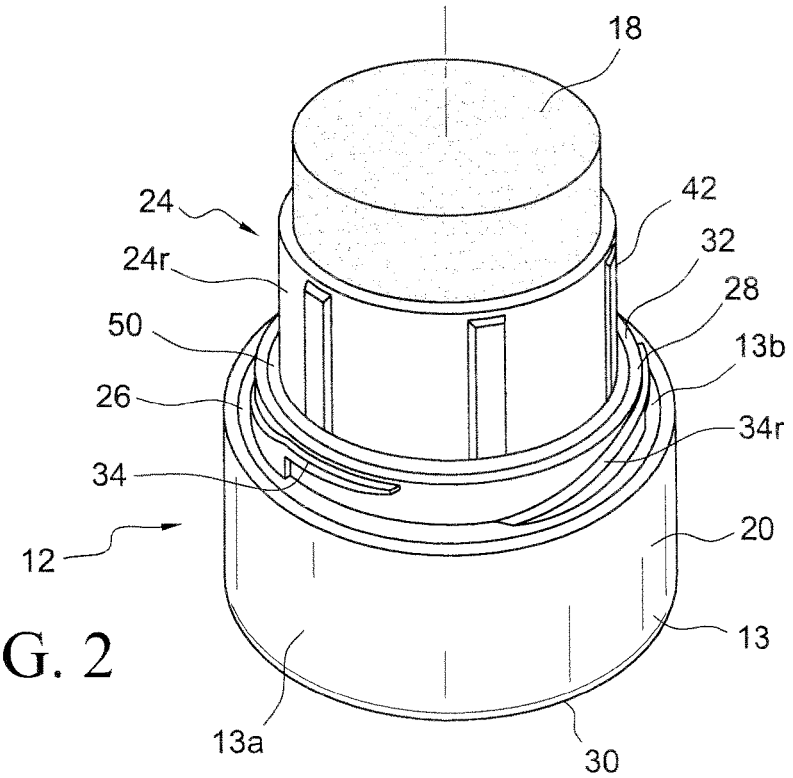
FIG. 2 is an exploded perspective view of the cosmetic product container.
Figure 2A:
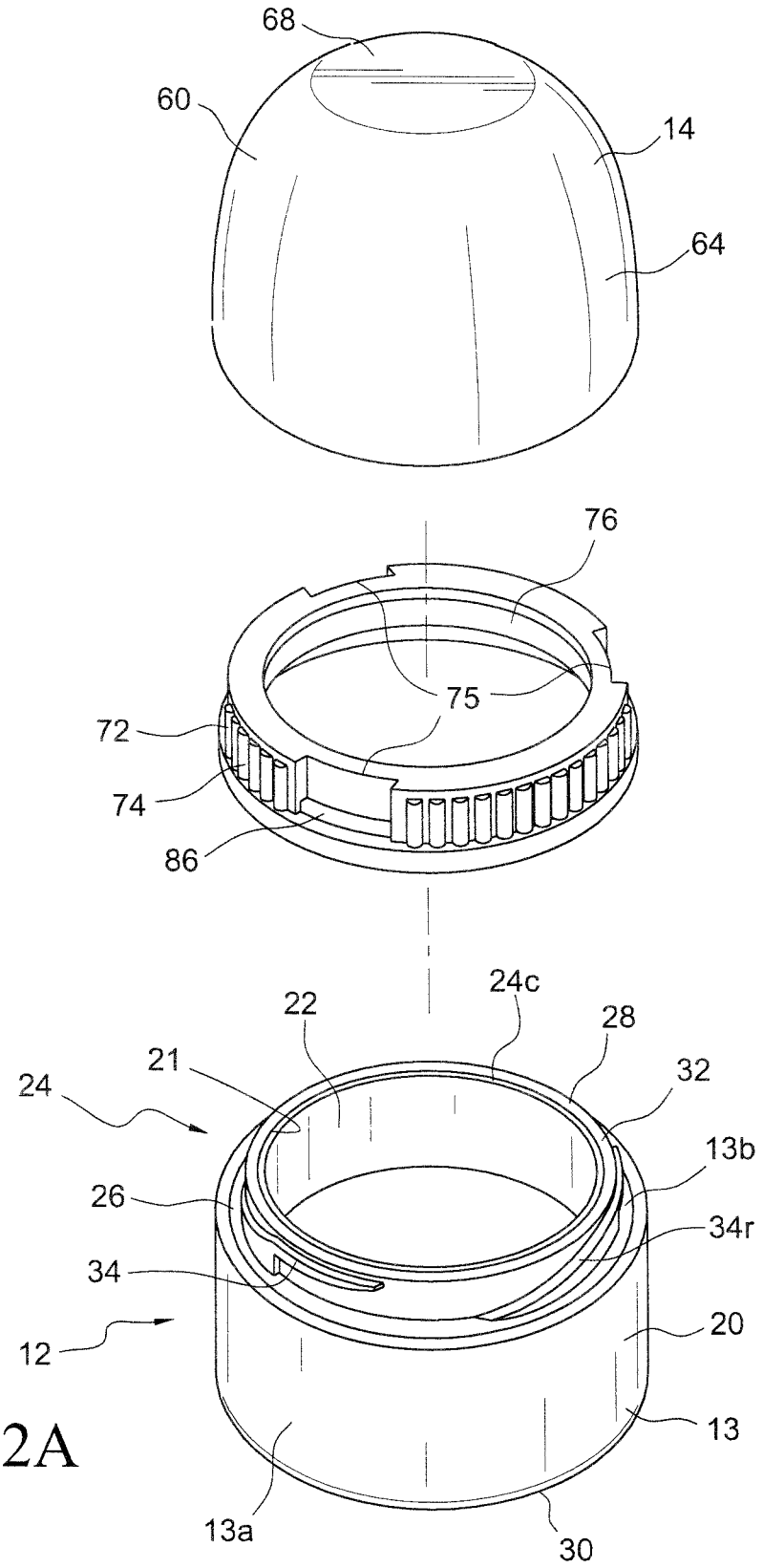
FIG. 2A is an exploded perspective view of the cosmetic product container in accordance with an alternate embodiment.
Figure 3:
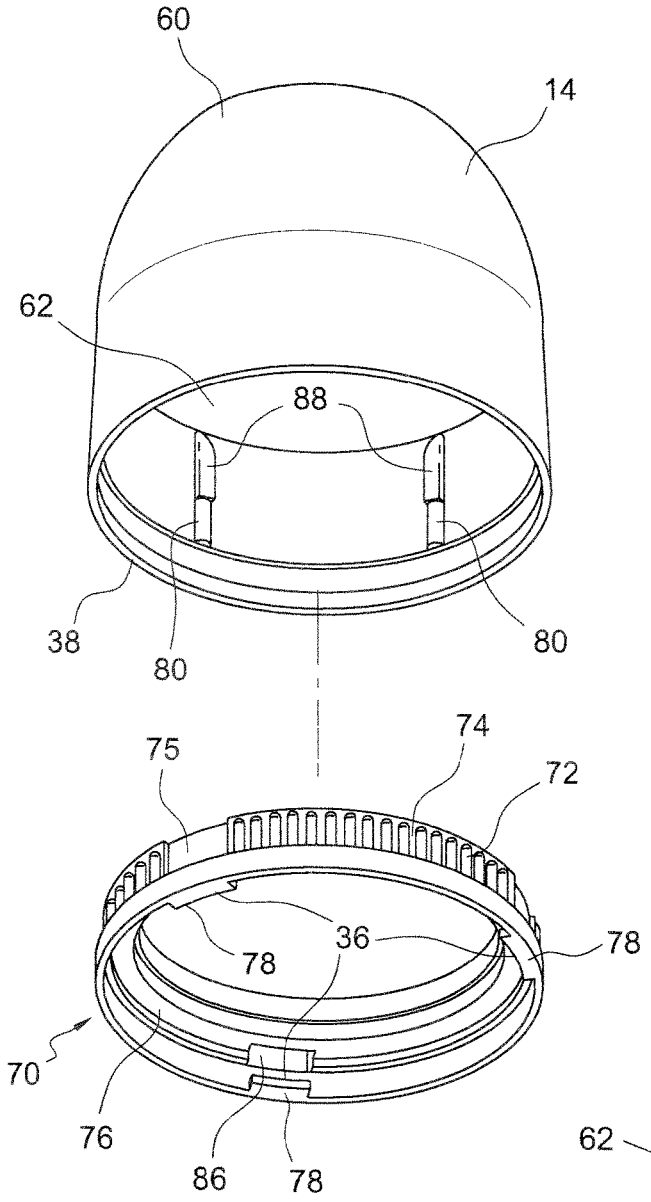
FIG. 3 is an exploded perspective view of the cap member.
Figure 4:
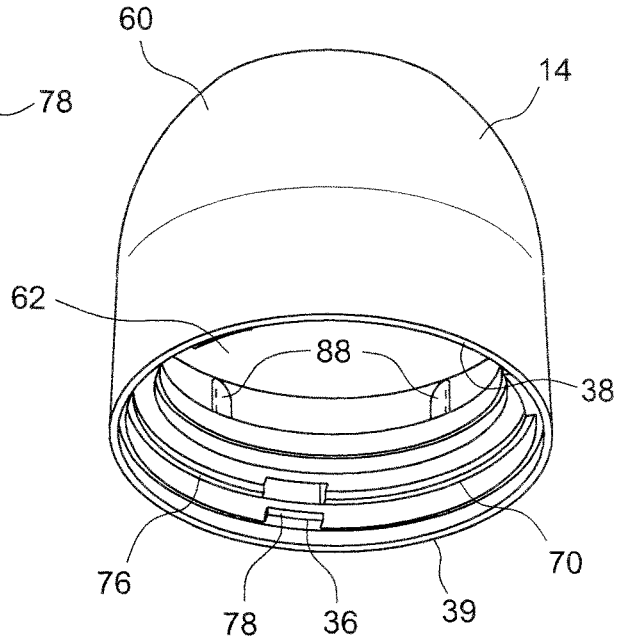
FIG. 4 is an assembled perspective view of the cap member.
Figure 5:
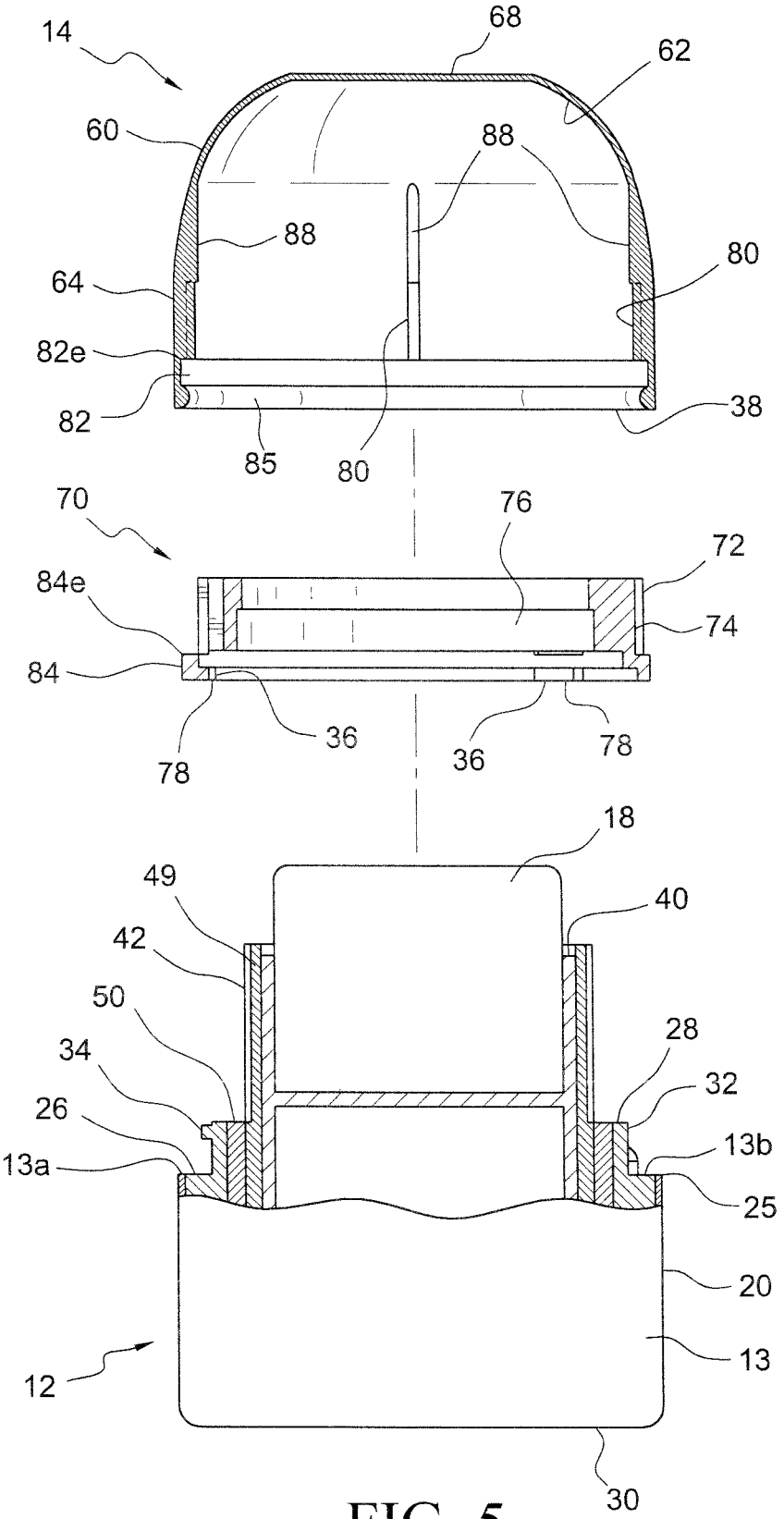
FIG. 5 is an exploded cross sectional view of the cosmetic product container.
Figure 6:
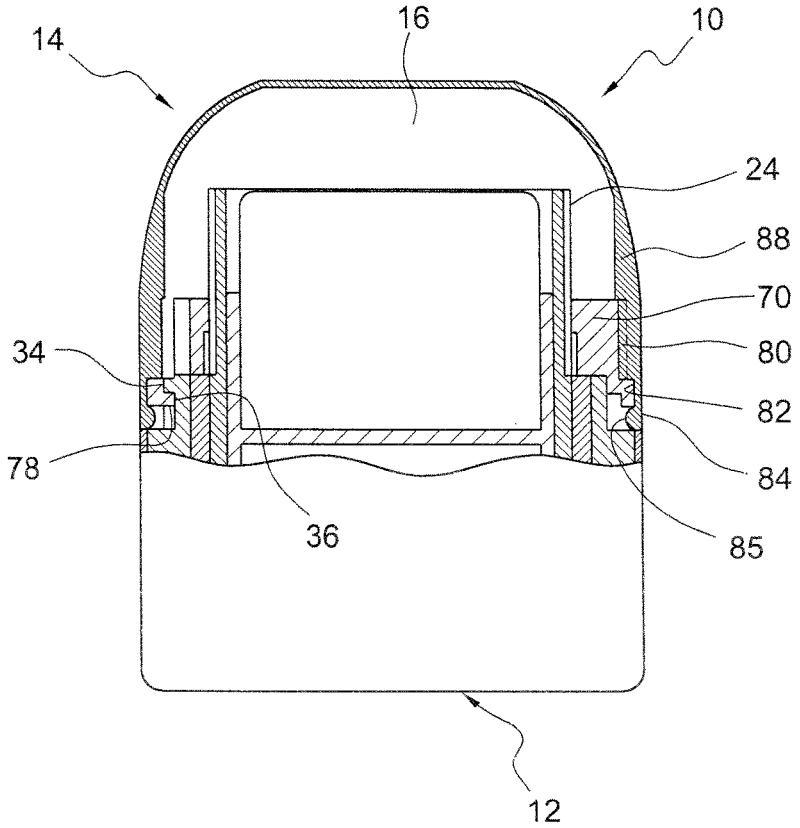
FIG. 6 is an assembled cross sectional view of the cosmetic product container.
Figure 7A:
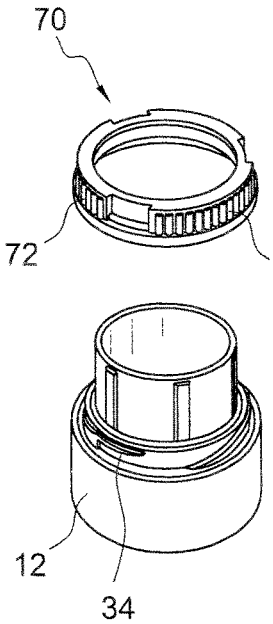
FIGS. 7A-7D show the process for assembly of the present cosmetic product container.
Figure 7B:
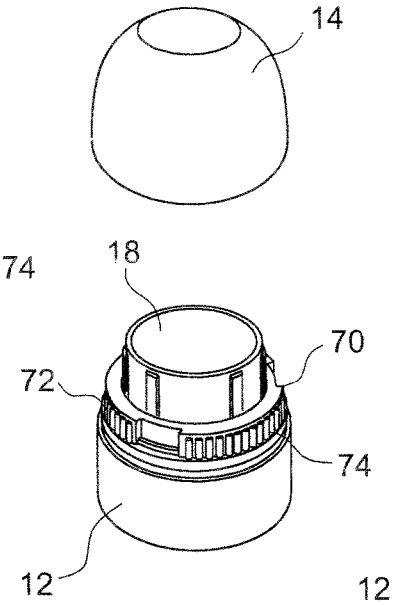
Figure 7C:
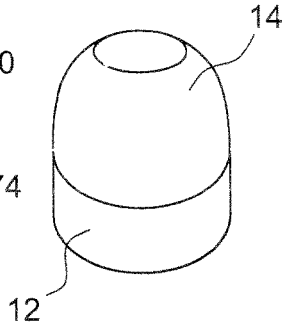
Figure 7D:
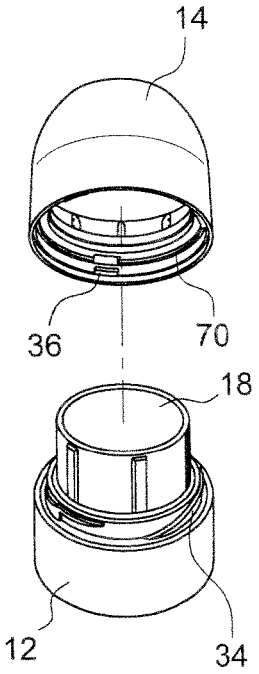

With that in mind, and with reference to FIGS. 2, 5 and 6, the rotary dispensing assembly 24*r* is of a conventional design and includes a cylindrical elevator support structure 40 mounted for longitudinal or vertical movement within a cylindrical inner sleeve 42. Projecting from the outer cylindrical surface 44 of the cylindrical elevator support structure 40 are a pair of diametrically opposed lugs (not shown) which are adapted to pass through a pair of diametrically opposed slots (not shown) formed in the side wall 49 of the cylindrical inner sleeve 42. Each slot of the cylindrical inner sleeve 42 is formed with a spiral configuration in a known manner so as to allow for the elevation of the cylindrical elevator support structure 40 when the cylindrical elevator support structure 40 is rotated relative to the cylindrical inner sleeve 42.

The rotary dispensing assembly 24*r* also includes a cylindrical outer sleeve 50 positioned to surround the cylindrical inner sleeve 42. The cylindrical outer sleeve 50 is fixedly secured to the base member housing 13. The cylindrical outer sleeve 50 is also secured to the cylindrical elevator support structure 40 such that the cylindrical elevator support structure 40 rotates with the cylindrical outer sleeve 50 as the cylindrical outer sleeve 50 is rotated relative to the cylindrical inner sleeve 42.

The cylindrical elevator support structure 40, the cylindrical inner sleeve 42, and the cylindrical outer sleeve 50 are all separately molded, and are ultimately inserted into the base member 12.

In manipulating the rotary dispensing assembly 24*r*, the cosmetic product 18 within the cylindrical elevator support structure 40 may be moved up and down as desired by simply rotating the cylindrical inner sleeve 42 relative to the base member 12. Because the cylindrical outer sleeve 50 is fixedly secured to the base member housing 13 and the cylindrical elevator support structure 40 is secured to the cylindrical outer sleeve 50, rotation of the base member 12 relative to the cylindrical inner sleeve 42 causes the cylindrical elevator support structure 40 to also rotate relative to the cylindrical inner sleeve 42. As the cylindrical elevator support structure 40 rotates relative to the cylindrical inner sleeve 42, the lugs of the cylindrical elevator support structure 40 ride along the slots of the cylindrical inner sleeve 42 to cause the cylindrical elevator support structure 40 to move up or down. When in use, the cylindrical elevator support structure 40 is retained in place by frictional interaction between the lugs of the cylindrical elevator support structure 40 and the slots 48 of the cylindrical inner sleeve 42.

The base member housing 13 includes a circumferential ledge 26 and an upwardly extending ridge 32 having external threading 34 formed thereupon. The upwardly extending ridge 32 extends upwardly from the circumferential ledge 26 to the open upper first end 28 of the base member 12. In accordance with the disclosed embodiment, the upwardly extending ridge 32 having external threading 34 is formed as the upper portion of the threaded member 13*b*, which sits above the upper edge 25 of the cover 13*a*. The upper edge 25 of cover 13*a* is aligned in the same plane with the circumferential ledge 26.

The external threading 34 is shaped and dimensioned for engagement with internal threading 36 attached along an interior surface 62 of the cap member 14 adjacent the circumferential free edge 39 of the cap member 14. It is appreciated that the external threading 34 of the base member 12 is relatively short such that limited turning of the cap member 14 relative to the base member 12 is required to disengage or reengage the cap member 14 relative to the base member 12. The use of such short threading functions in a manner similar to a bayonet connection and allows for convenient and reliable use of the present container 10. It is, however, appreciated other threading arrangements may be employed in accordance with the present invention.

Removal of the cap member 14 from the base member 12 is further facilitated by providing the external threading 34 of the base member 12 with an upper ramp surface 34*r* that functions to lift the cap member 14 from the base member 12 when the cap member 14 is rotated to disengage the cap member 14 from the base member 12.

The cap member 14 is of a "substantially" semi-spherical configuration, but could be formed in a variety of shapes, such as cylindrical. The cap member 14 includes an exterior surface 60 and an interior surface 62. The cap member 14 includes side walls 64 with a flat top 68. The cap member 14 includes a circumferential free edge 39 along the open end 38 thereof. Adjacent the circumferential free edge 39, and along the interior surface 62 of the cap member 14, internal threading 36 is attached after assembly as discussed below in greater detail. The internal threading 36 is shaped and dimensioned for engagement with the external threading 34 formed along the upwardly extending ridge 32 of the base member 12. In this way, the base member 12 and the cap member 14 may be selectively attached and detached so as to expose the cosmetic product 18 maintained in the base member 12.

In accordance with the present invention, the internal threading 36 of the cap member 14 is formed as a separate element, referred to herein as the threaded cap engagement member 70, that is secured to the interior surface 62 of the cap member 14.

The threaded cap engagement member 70 is substantially annular in shape and it includes an exterior surface 72 formed with a series of grooves 74 extending normal to the plane in which the threaded cap engagement member 70 lies. With the exception of three recesses 75, the grooves 74 are positioned about the circumference of the exterior surface 72 of the threaded cap engagement member 70. The interior surface 76 of the threaded cap engagement member 70 is formed with small internal projections 78 (which ultimately define the internal threading 36 of the cap member 14) shaped and dimensioned for engagement with the external threading 34 formed along the upwardly extending ridge 32 of the base member 12. In this way, and during assembly, the threaded cap engagement member 70 is positioned along the upper end 28 of the base member 12 and when the cap member 14 is pressed downwardly upon the base member 12, the threaded cap engagement member 70 snaps onto the interior surface 62 of the cap member 14 to thereby define the internal threading 36 that is subsequently used as the cap member 14 is attached and removed from the base member 12.

Alignment of the threaded cap engagement member 70 along the interior surface 62 of the cap member 14 is achieved by providing the interior surface 62 of the cap member 14 with a series of small projecting ribs 80 shaped and dimensioned for interdigitating with the grooves 74 formed along the exterior surface 72 of the threaded cap engagement member 70 to couple the threaded cap engagement member 70 along the interior surface 62 of the cap member 14 in a manner preventing relative rotation between the threaded cap engagement member 70 and the cap member 14. The small projecting ribs 80 seat within the grooves 74 to align the cap member 14 with the exterior surface 72 of the threaded cap engagement member 70.

The cap member 14 and the threaded cap engagement member 70 respectively include mating structures allowing for frictional coupling of the cap member 14 and the threaded cap engagement member 70 when the cap member 14 is pressed downwardly over the threaded cap engagement member 70. In particular, attachment of the cap member 14 with the threaded cap engagement member 70 is completed through the provision of a slight circumferential recess 82 formed along the interior surface 62 of the cap member 14 adjacent the open end 38 thereof. Similarly, threaded cap engagement member 70 is provided with a circumferential projection 84 shaped and dimensioned for positioning within the circumferential recess 82 at the open end 38 of the cap remember 14. Secure seating of the circumferential projection 84 within the circumferential recess 82 is achieved by shaping the circumferential projection 84, the circumferential recess 82, and the interior surface 62 of the cap member 14 adjacent the circumferential free edge 39 in a manner ensuring the circumferential projection 84 reliably and securely seats within the circumferential recess 82. In particular, the interior surface 62 of the cap member 14 adjacent the circumferential free edge 39 is formed with a convex rounded surface 85 that urges the circumferential projection 84 into the circumferential recess 82. Further, the upper edge 84*e* of the circumferential projection 84 is squared off and the upper corner 82*e* of the circumferential recess is squared off to ensure the threaded cap engagement member 70 does not move beyond its desired position within the cap member 14. Once the threaded cap engagement member 70 is properly positioned within the cap member 14 and the circumferential projection 84 is seated within the circumferential recess 82 the threaded cap engagement member very difficult to remove from the cap member 14.

It will be noted that the threaded cap engagement member 70 includes three openings 86 (within the recesses 75) extending between the exterior surface 72 and the interior surface 76 of the threaded cap engagement member 70. The openings 86 are necessary to allow for the injection molding of the threaded engagement member 70 and the forming of the small internal projections 78 below the openings 86.

In practice, and with reference to FIGS. 7A to 7D, the parts of the present container 10 are first molded. Thereafter, the base member 12 is assembled and the threaded cap engagement member 70 is secured along the upper end 28 of the base member 12 and the small internal projections 78 (that is, the projections which form internal threading 36) along the interior surface 76 of the threaded cap engagement number 70 are engaged with the external threading 34 on upwardly extending ridge 32 of the base member 12. The cosmetic product 18 is then poured within the dispensing assembly 24 to cure.

With the threaded cap engagement member 70 secured to the upper end 28 of the base member 12, the cap member 14 is pressed downwardly over the base member 12. The small projecting ribs 80 of the cap member 14 engage with the grooves 74 of the threaded cap engagement member 70. Further force pushes the cap member 14 over the threaded cap engagement member 70 until such a time as the circumferential projection 84 along the threaded cap engagement member 70 seats within the circumferential recess 82 formed along the interior surface 62 of the cap member 14 and projecting ribs 80 interdigitate with grooves 74. Movement of the threaded cap engagement member 70 into the cap member 14 in the direction of the cap member top 68 is limited by the provision of limiting projections 88 along the interior surface 62 of the cap member 14. It is noted that the limiting projections 88 may be coextensive with the small projecting ribs 80, although the limiting projections 88 extend further inwardly to achieve their goal of limiting the movement of the threaded cap engagement member 70 into the cap member 14 in the direction of the top 68. At this point, the threaded cap engagement member 70 is secured to the cap member 14 and the cap member 14 may be rotated to secure and release it from the base member 12.

In addition to allowing for alignment of the cap member 14 with the threaded cap engagement member 70 during assembly, the small projecting ribs 80 of the cap member 14 interact with the grooves 74 of the threaded cap engagement member 70 to prevent relative rotary motion between the threaded cap engagement member 70 and the cap member 14 thereby allowing for proper threading of the cap member 14 with the upper end 28 of the base member 12.

While the preferred embodiments have been shown and described, it will be understood that there is no intent to limit the invention by such disclosure, but rather, it is intended to cover all modifications and alternate constructions falling within the spirit and scope of the invention.

The invention claimed is:

1. A cosmetic container, comprising:

a base member including a base member housing with an exterior surface and an interior surface defining a cavity;

a cap member shaped and dimensioned for selectively coupling to the base member, the cap member including an interior surface having a series of projecting ribs;

a threaded cap engagement member shaped and dimensioned for securing to an interior surface of the cap member, wherein the threaded cap engagement member is annular in shape having a central opening allowing for cosmetic product to be poured therethrough, and the threaded engagement cap includes an exterior surface with a series of grooves positioned about the circumference of the exterior surface of the threaded cap engagement member and an interior surface formed with internal projections defining internal threading of the cap member when the threaded cap engagement member is secured to the interior surface of the cap member; and wherein the series of projecting ribs are shaped and dimensioned for interdigitating with the series of grooves formed along the exterior surface of the threaded cap engagement member to couple the threaded cap engagement member along the interior surface of the cap member in a manner preventing relative rotation between the threaded cap engagement member and the cap member.

2. The cosmetic container according to claim 1, wherein the interior surface of the cap member includes limiting projections along the interior surface of the cap member, wherein the limiting projections extend further inwardly relative to the interior surface of the cap member than the series of projecting ribs and limit the movement of the threaded cap engagement member into the cap member.

3. The cosmetic container according to claim 2, wherein the limiting projections are coextensive with the series of projecting ribs.

4. The cosmetic container according to claim 1, wherein the cap member includes a circumferential recess formed along the interior surface thereof and the threaded cap engagement member includes a circumferential projection shaped and dimensioned for positioning within the circumferential recess.

5. The cosmetic container according to claim 1, wherein the base member is cylindrical shaped and includes an open upper first end and a closed lower second end.

6. The cosmetic container according to claim 1, wherein the base member housing is of a two-piece construction and includes a cover in the shape of a cup and a cylindrical threaded member shaped and dimensioned to fit within the cover.

7. The cosmetic container according to claim 6, wherein the threaded member is positioned and secured within the cover via a frictional fit.

8. The cosmetic container according to claim 1, wherein the base member housing includes a circumferential ledge and an upwardly extending ridge having external threading formed thereupon, the upwardly extending ridge extends upwardly from the circumferential ledge to an open upper first end of the base member.

9. The cosmetic container according to claim 8, wherein the external threading is shaped and dimensioned for engagement with internal threading of the threaded cap engagement member.

10. The cosmetic container according to claim 1, further including a rotary dispensing assembly positioned within the cavity of the base member.

11. The cosmetic container according to claim 10, wherein the rotary dispensing assembly includes a cylindrical elevator support structure mounted for movement within a cylindrical inner sleeve.

12. The cosmetic container according to claim 11, wherein the rotary dispensing assembly further includes a cylindrical outer sleeve surrounding the cylindrical inner sleeve, the cylindrical outer sleeve being fixedly secured to the base member housing and the cylindrical outer sleeve is secured to the cylindrical elevator support structure such that the cylindrical elevator support structure rotates with the cylindrical outer sleeve as the cylindrical outer sleeve is rotated relative to the cylindrical inner sleeve.

* * * * *